US005800061A

United States Patent [19]

Volles

[11] Patent Number: 5,800,061

[45] Date of Patent: Sep. 1, 1998

[54] REVERSIBLE POUCH FOR CARRYING FOOD CONTAINERS

[75] Inventor: Jacqueline G. Volles, Dublin, Ohio

[73] Assignee: Anchor Hocking Corporation, Freeport, Ill.

[21] Appl. No.: 780,805

[22] Filed: Jan. 9, 1997

[51] Int. Cl.[6] ..... B65D 33/06

[52] U.S. Cl. ..... 383/15; 383/16; 383/99; 383/110; 150/103

[58] Field of Search ..... 383/15, 110, 4, 383/19, 16, 98, 99; 150/103; 224/153, 578, 579, 655

[56] References Cited

U.S. PATENT DOCUMENTS

| | | | |
|---|---|---|---|
| 1,768,989 | 7/1930 | Laacke | 383/99 |
| 2,635,664 | 4/1953 | Cohen | 150/103 |
| 3,550,663 | 12/1970 | Johnston | 150/103 |
| 3,683,987 | 8/1972 | Robertson | 383/99 |
| 3,847,194 | 11/1974 | Corigliano | 150/103 |
| 4,204,565 | 5/1980 | Nohmura | 383/99 |
| 4,301,849 | 11/1981 | Litwack et al. | 150/103 |
| 4,578,814 | 3/1986 | Skamser | 383/110 X |
| 4,802,233 | 1/1989 | Skamser | 383/15 |
| 4,881,684 | 11/1989 | Chinman | 383/4 X |
| 5,047,001 | 9/1991 | Willis | 383/16 X |
| 5,361,951 | 11/1994 | Cheheber | 150/103 X |
| 5,653,337 | 8/1997 | Ciriliano | 224/153 X |

*Primary Examiner*—Jes F. Pascua
*Attorney, Agent, or Firm*—Foley & Lardner

[57] ABSTRACT

A reversible pouch for carrying food containers such as casserole dishes, cake pans, and the like, includes a body which is fully reversible and two sets of handles to be used depending on which configuration is chosen. In the preferred embodiment, four flaps are provided which may be folded in a variety of ways. By selecting different colors, patterns or textures for the two sides of the pouch and for one or more sets of the flaps, a wide variety of decorative combinations are provided. For example, by appropriate selections of design and/or color, one configuration of the pouch would be suitable for summer picnics, while in another configuration, the pouch would be appropriate for use during the Christmas holidays.

17 Claims, 3 Drawing Sheets

REVERSIBLE POUCH FOR CARRYING FOOD CONTAINERS

BACKGROUND OF THE INVENTION

1. Field of the Invention

The present invention relates generally to the field of carriers for food dishes, bowls, pans, and the like, and more particularly to a carrier which is fully reversible to allow the user to display two or more surface appearances. Still more specifically, the present invention, in its most preferred form, relates to a pouch for food containers which includes a body which is fully reversible, two pairs of handles and a plurality of flaps which may be closed in a variety of ways.

2. Description of the Prior Art

A wide variety of carriers for food containers are known in the art. Such carriers have been used for years to carry hot casserole dishes, cake pans, salad bowls and the like from the place of preparation to the place of serving. It is also known to provide insulated carriers with handles, such as products sold by the assignee of the present invention under its CARRY-OUTS trademark and products sold by Corning Corporation under the PORTABLES brand name. These latter products include an insulated body conforming to a particular food container, such as a 9×13" rectangular casserole dish. The body includes a zipper for closure, and handles are provided to allow the food container and pouch to be easily transported. In the CARRY-OUTS product, internal straps are provided to secure the food container.

While such pouches are commercially successful and provide convenience to the user, they are not adaptable for use in a variety of festive environments where it may be desirable to match the color of the pouch with the remainder of the decor.

For example, pouches for food containers are used throughout the year for a variety of family, church, civic, and other get-togethers. The prior art pouches, which may be entirely suitable for use in the summer at an outdoor picnic, may not be aesthetically pleasing in the environment of a family Christmas dinner. Accordingly, there remains substantial room for improvement and innovation in the design of insulated pouches for food containers.

These prior art products may be made from nylon or other flexible sheet materials and may be insulated, for example, with sheets of insulating foam located between outer nylon facings. The pouches are typically sewn in the appropriate shape and handles of webbing may be attached thereto by fasteners or by sewing. It is also known that the midpoints of the handles can be locked together, such as by a VELCRO® hook and loop closure, as is known for gym bags, luggage and backpacking products.

It would represent a substantial advance in the art to have a pouch for food containers which would be insulating, easy to handle and which would be fully reversible.

FEATURES AND SUMMARY OF THE INVENTION

The present invention features a pouch for food containers which is fully reversible.

The present invention also features a pouch which may be decorated with different designs and/or colors on different reversible surfaces to provide a plurality of surface appearances.

The present invention also features a reversible pouch for food container having flaps, which themselves may be decorated with different colors and/or patterns, and which may be folded in different ways to increase the variety of decorative appearances.

A still further advantage of the present invention is to provide two separate sets of handles for the pouch so that it may be carried easily in its original or in its reversed orientation.

Yet a different feature of the present invention is providing a variety of fasteners on the flaps to permit closure of the pouch, both for heat/cold insulation and to prevent spillage, such fasteners preferably being of the VELCRO® hook and loop closure variety.

How these and other features of the present invention are accomplished will be described in the following detailed description of the preferred embodiment, taken in conjunction with the FIGURES. Generally, however, they are accomplished by providing a reversible pouch body which includes a floor, two side walls and two end walls in the most preferred form, i.e., a pouch for a rectangular or square casserole dish. Flaps are attached to each of the side and end walls, and insulation is preferably provided in the walls, the bottom and in each of the flaps. A VELCRO® hook and loop closure patch is provided on either side at the outer edge of each flap. A handle is located at each sidewall at the junction of the flap and the wall, with another set of handles being located on the other side of the pouch at the same line. If desired, and in the most preferred form of the invention, a VELCRO® hook and loop closure is provided for each set of handles to allow them to be joined securely for safe and comfortable transport. The body is fully reversible to allow the original interior to form the exterior of the pouch. In the most preferred embodiment, the interior and exterior of the pouch, as well as some or all of the flaps, are made from different materials, e.g. different colors, patterns or textures. This allows the pouch to have a different appearance when it is reversed. Still more variety is provided if the flaps are folded in different ways. Several variations of the present invention will be described in the following detailed description, and yet other variations will become readily apparent to those skilled in the art after reading the following specification. Such other ways of accomplishing the features of the invention are deemed to fall within the scope of the invention if they fall within the scope of the claims which follow.

DESCRIPTION OF THE FIGURES

In the respective FIGURES, like reference numerals are used to denote like components, and cross-hatching is used to illustrate one surface appearance as opposed to another.

DETAILED DESCRIPTION OF THE PREFERRED EMBODIMENT

Figure 1:
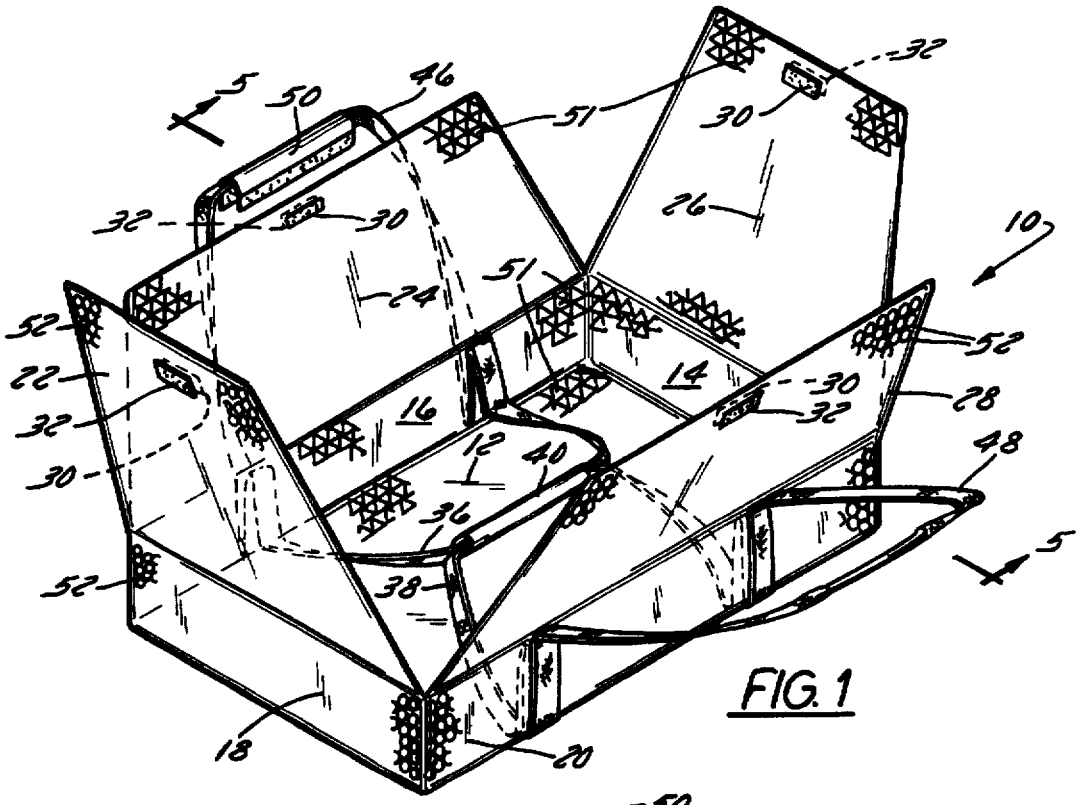
FIG. 1 is a perspective view of the pouch of the present invention opened to show the interior of the body, the insides of the flaps, the interior handles, the handle closure, and the exterior set of handles, with various components shown partially in phantom.

Before proceeding to the detailed description of the preferred embodiment, several general comments can be made with regard to the applicability and the scope of the present invention. First, the dimensions of the pouch may be variously embodied and the pouch, for example, can be square, hexagonal or any other shape, as will become apparent to those skilled in the art after they have read the present specification.

Second, the particular materials used to construct the pouch can also be widely varied. Synthetic materials, such as nylon, may be used for the facing sheets in the pouch. Other materials such as canvas and the like may also be used.

Third, in the preferred embodiment, insulation is provided between the inner and outer sheets of material to provide both padding and insulation to maintain food articles carried within the pouch in a warm or cold condition. The type of insulation can be selected from those commonly used in this art, such as urethane foam. The particular thickness and chemical composition thereof can be widely varied.

Fourth, in the preferred embodiment, two sets of carrying handles are provided, and they are made from webbing. Other types of straps and cords may be used, such as those found in the luggage, camping or backpacking fields. The handles are preferably secured to one another using a VELCRO® hook and loop closure such as is also common in these same fields of use. The illustrated closure is a cylindrical, open sleeve attached to one handle which may be opened along its length to receive the other handle.

Fifth, in the illustrated embodiment, VELCRO® hook and loop patches are used to secure both the handles and to one another and to secure opposed pairs of flaps. Other types of closures, such as snaps could be substituted without departing from the spirit or scope of the invention.

Sixth, the particular colors, patterns or texture for the sheets used on the inside and outside of the pouch can be selected from an enormous variety. In the most preferred embodiment, the visual appearance, whether depending on color, pattern, texture or any combination thereof, is different on the inside and outside of the pouch so that when it is reversed, a different visual appearance will be created. As mentioned earlier, such choices may be dictated by the particular occasion at which the pouch is to be used or by matching the decor of a particular serving environment. In the description below, small circles and triangles are used to illustrate the differences of appearance.

Seventh, the illustrated embodiment shows a single visual appearance for all of the inside surfaces and a different physical appearance for all of the outside surfaces. It is within the scope of the present invention to provide different visual appearances for certain of the flaps, so that when they are closed in different configurations, as shown for example in FIGS. 2 and 3, still further visual distinctions can be made.

Finally, while the pouch of the present invention is particularly well suited for the carrying of food containers, its scope should not be limited thereto as other types of products could be carried within the secure confines of the pouch.

Proceeding now to the description of the preferred embodiment of the present invention, an open pouch 10 according to the present invention is shown in FIG. 1. The pouch includes a floor 12, four side walls, 14, 16, 18 and 20, the side walls being attached to the floor and to one another, such as by sewing, adhesives or the like. A series of four flaps 22, 24, 26 and 28 are attached to the upper edges of the side walls, flaps 22 and 26 being opposed to one another and flaps 24 to 28 being opposed to one another.

Since the illustrated shape of the pouch 10 is rectangular, the flaps 24 and 28 are longer than flaps 22 and 26, but all the flaps are generally trapezoidal shape. A pair of VELCRO® hook and loop patches are attached to each flap, the interior VELCRO® hook and loop closure patches being shown at 30 and the exterior VELCRO® hook and loop closure patches being shown at 32. Patches 30 and 32 are arranged so that when the flaps are folded so that they are parallel to and overlie floor 12, the VELCRO® hook and loop closure will engage to secure opposed pairs of flaps.

The remaining components of pouch 10 are a pair of sets of handles, the first formed by a pair of loop handle straps 36 and 38 which are releasably secured to one another by a closure device 40. Loops 36 and 38 are attached at the sides of pouch 10 along the lines joining respectively side wall 16 to flap 24 and side wall 20 to flap 28. In the orientation shown in FIG. 1, handles 36 and 38 would lie against floor 12 and the container to be carried within the pouch would rest on top thereof. In the illustrated embodiment, the handles are attached by sewing them to side walls.

The exterior handle straps 46 and 48 are attached at the exterior and also may be joined at their midpoints by a closure member 50. The closure is preferably of the VELCRO® type and is shown in the opened position in FIG. 2.

Before leaving FIG. 1, it is important to note that the interior and exterior surfaces of pouch 10 have a different visual appearance. In this FIGURE, small triangles 51 are used to show the interior surfaces, while small circles 52 are used to show the visual appearance of the exterior surface.

Figure 2:
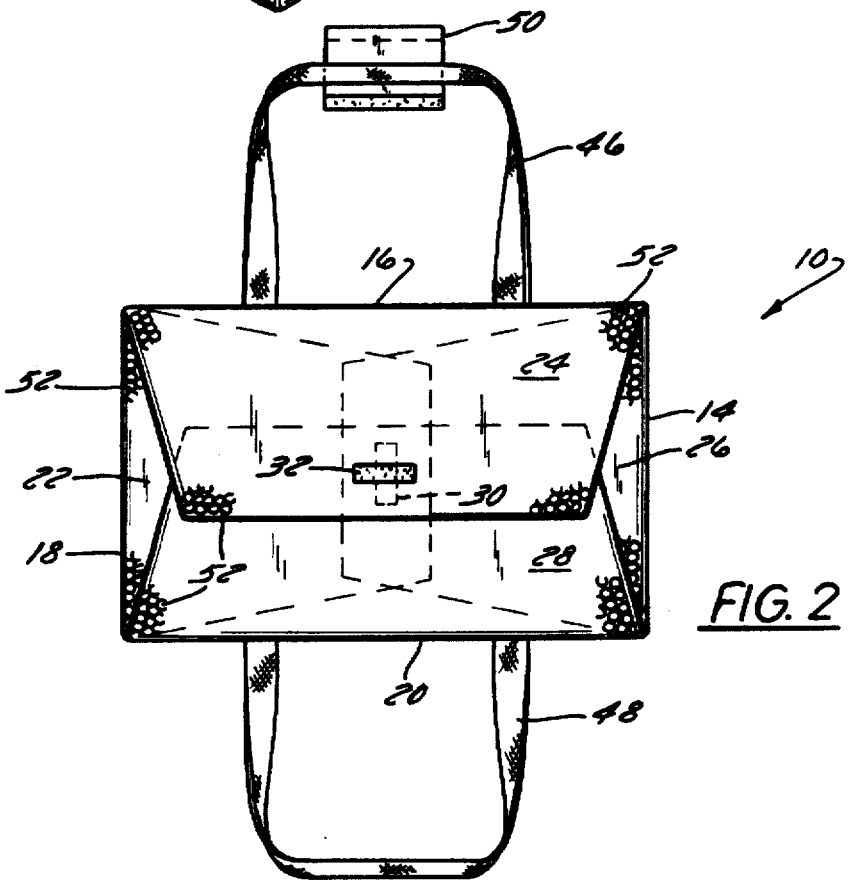
FIG. 2 is a top plan view of the pouch shown in FIG. 1 with the four flaps closed in a first configuration and showing the interior flap configurations in phantom.

Proceeding next to FIG. 2, pouch 10 is illustrated with the flaps in their closed positions. Flaps 22 and 26 have been closed first and are shown partially in phantom. Flap 24 has then been placed on top of the flaps 22 and 26, and flap 28 closed thereover. The handles 46 and 48 are shown in their open position for purposes of illustration. The triangle surface 51 is no longer visible.

Figure 3:
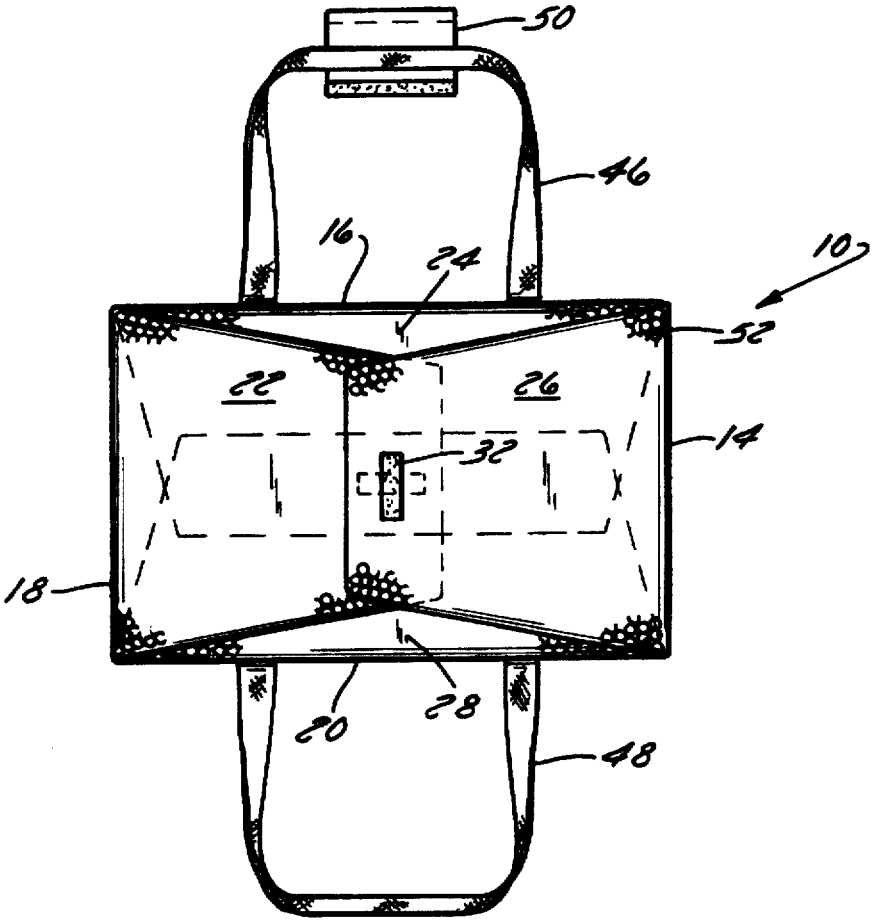
FIG. 3 is a view similar to FIG. 2 but showing the pouch when the flaps are closed in a different configuration than in FIG. 2.

A view similar to FIG. 2 is provided in FIG. 3, but in this FIGURE, flaps 24 and 28 have been closed first, following which flap 22 was closed and finally flap 26 was closed thereover. As can be seen from this FIGURE, the dominant upward surface is flaps 22 and 26 and, if for example, the flap materials had different visual characteristics, a different looking pouch would be present than that illustrated in FIG. 2.

Figure 4:
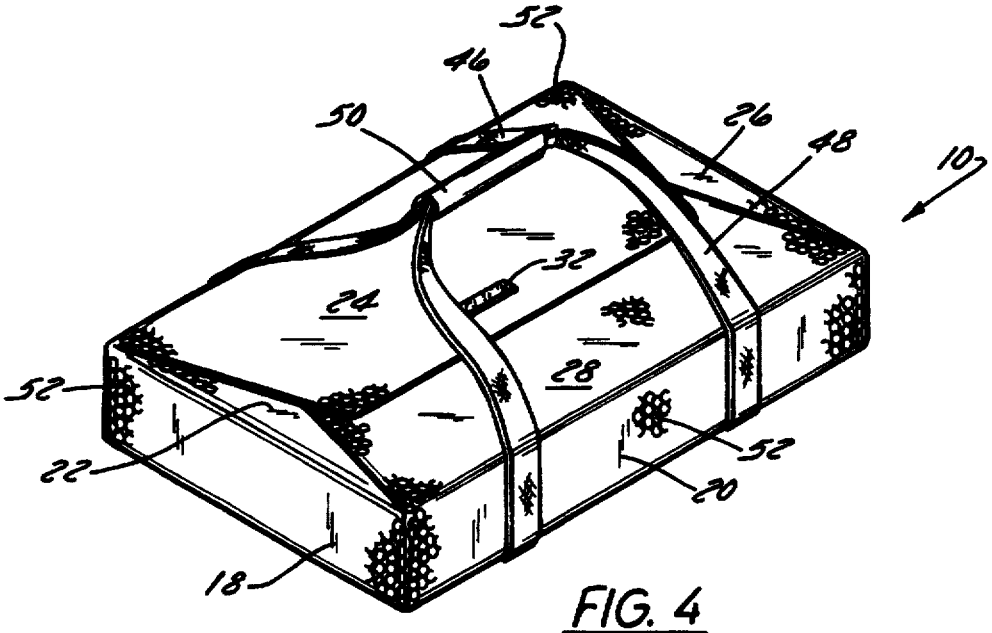
FIG. 4 is a perspective view of the pouch shown in FIG. 1 with the flaps closed and the handles secured to one another.

FIG. 4 is similar to FIG. 2 except that the midpoints of handles 46 and 48 have been joined to one another by closure 50.

Figure 5:
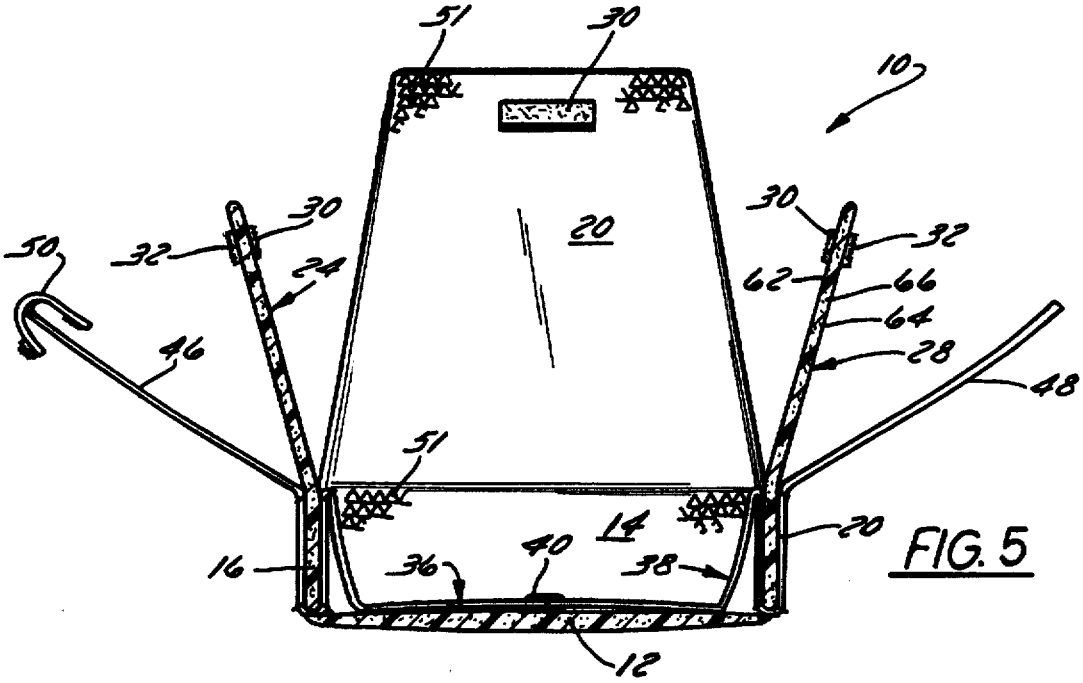
FIG. 5 is a sectional view taken along the line 5—5 of FIG. 1.

FIG. 5 is a sectional view taken along the line 5—5 of FIG. 1. In this view, the two pairs of handles (36–38 and 46–48) are shown as they would appear in the orientation shown in FIG. 1. Moreover, it can be noted that each of the bottom 12, side walls (14, 16, 18 and 20) and the flaps (22, 24, 26 and 28) are comprised of an inwardly facing sheet of flexible material 62, an outwardly facing sheet of material 64 and an inner layer 66 of insulation, such as polyurethane foam. The insulation and sheets may be bonded to one another, such as by flame bonding or by adhesive, or the insulation may be loosely inserted in the form of sheet, batting or the like. FIG. 5 also illustrates the fact that the sheets 62 and 64 may extend over substantial portions of pouch 10. In connection with visual appearance, the inner sheet 62 has the triangular surface appearance 51 while the outer sheet 66 has the circle configuration 52.

Figure 6:
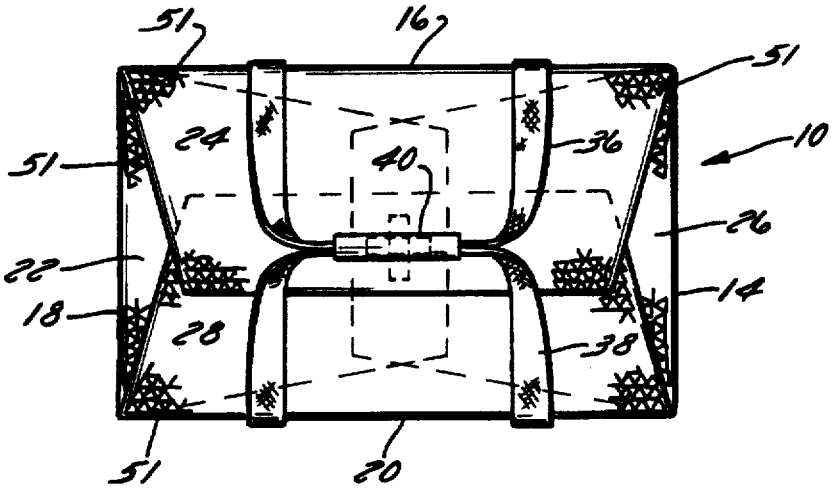
FIG. 6 is a top plan view, but showing the pouch fully reversed so that the material initially on the interior is now on the exterior of the pouch.

By reference to FIGS. 1 and 5 it will also be appreciated that the flexibility of sheets 62 and 64 allows for full reversibility of pouch 10. By reference to FIG. 1, merely pushing the floor 12 upwardly from the bottom will allow the interior of floor 12 to become the exterior and will allow for full reversibility of the surface appearances 51 and 52. This is illustrated in FIG. 6 where interior handles 36 and 38 now are oriented toward the outside of pouch 10 and wherein the triangular surface appearance 52 extends toward the outside for all components. The flaps are folded and secured when the pouch is reversed in the same manner as in the orientation shown in FIGS. 1–4. Note that the VELCRO® hook and loop closure patches 30 and 32 are located on either side of each flap.

While the present invention has been described in connection with a single preferred embodiment, variations may be made to this embodiment as indicated above and fall within the scope of the present invention if they fall within the scope of the claims which follow.

What is claimed is:

1. A device for carrying a container comprising:

a pouch for receiving the container and having a floor and a plurality of side walls, a flap attached to each of the side walls along an edge thereof spaced from the floor, means on each flap for releasably securing the flap to another flap when the flaps are folded to a position in which they are parallel to and overlie the floor and overlap at least one other flap, a pair of loop carrying handles located on each of the inside and the outside of the pouch, the pouch being reversible so that the inner surface of the floor and side walls become the outer surface of the floor and side walls and so that the surfaces of each flap previously facing toward the inside of the device face outwardly therefrom when reversed and so that a pair of carrying handles is available on the outside of the pouch when the pouch is in its original or reversed orientation.

2. The device of claim 1, wherein the pouch is formed of two sheets of flexible material and wherein insulation is provided between the sheets of material.

3. The device of claim 2 wherein the flaps are formed of two sheets of flexible material and wherein insulation is provided between the sheets.

4. The device of claim 1 wherein the loop handles are made of webbing.

5. The device of claim 4 wherein a fastener is provided for joining the midpoints of each pair of handles to facilitate carrying the device.

6. The device of claim 5 wherein each fastener is a split, generally-cylindrical sleeve secured to one handle and including a means for opening and closing the sleeve to receive the other handle.

7. The device of claim 1 wherein the visual appearance of the opposite surfaces of the pouch and flaps are different, whereby a different outward visual appearance is displayed to an observer when the pouch is reversed.

8. The device of claim 7 wherein the different visual appearance is in a characteristic selected from the group consisting of color, texture or pattern of the materials used to construct the pouch and flaps.

9. The device of claim 1 wherein four side walls define a rectangular pouch, two opposed side walls being longer than the other two opposed side walls.

10. A carrying pouch for a rectangular food container having a flexible, rectangular floor, flexible side walls attached to each edge of the floor with adjacent ends of each side wall being attached to one another, a flap secured to the upper edge of each side wall and arranged to close the pouch when folded to a position in which the flaps are parallel to the floor and at least partially overlap one another, the pouch being fully reversible, whereby surfaces of the floor, side walls and flaps originally oriented to face inwardly become oriented to face outwardly, the visual appearance of the inwardly and outwardly facing surfaces being different from one another; and wherein two pairs of carrying handles are provided for the pouch to facilitate carrying the pouch regardless of the orientation of the surfaces, one pair of carrying handles being attached to the pouch surface originally oriented inwardly and the other pair of carrying handles being attached to the pouch surface originally oriented outwardly.

11. The device of claim 10 wherein the floor, side walls and flaps are formed from first and second sheets of flexible material with insulation provided between the sheets.

12. The device of claim 10 wherein the different visual appearances are created by differences in a characteristic selected from the group consisting of color, texture or pattern.

13. The device of claim 10 wherein each of the flaps is trapezoidal in shape and the flaps are arranged so that either pair of opposed flaps may be folded and releasably secured to one another before the other pair of opposed flaps are folded and releasably secured to one another.

14. A device for carrying a container comprising:

a pouch for receiving the container and having a floor and a plurality of side walls, a flap attached to each of the side walls along an edge thereof spaced from the floor, means on each flap for releasably securing the flap to another flap when the flaps are folded to a position in which they are parallel to and overlie the floor and overlap at least one other flap, a pair of loop carrying handles located on each of the inside and the outside of the pouch, the pouch being reversible so that the inner surface of the floor and side walls become the outer surface of the floor and side walls and so that the surfaces of each flap previously facing toward the inside of the device face outwardly therefrom when reversed and so that a pair of carrying handles is available on the outside of the pouch when the pouch is in its original or reversed orientation and wherein the securing means is a hook and loop fastener.

15. The device of claim 14 wherein the hook and loop fastener is provided in the form of discrete patches on both sides of the flaps at a location thereof remote from the edges.

16. A device for carrying a container comprising:

a pouch for receiving the container and having a floor and a plurality of side walls, a flap attached to each of the side walls along an edge thereof spaced from the floor, means on each flap for releasably securing the flap to another flap when the flaps are folded to a position in which they are parallel to and overlie the floor and overlap at least one other flap, a pair of loop carrying handles located on each of the inside and the outside of the pouch, the pouch being reversible so that the inner surface of the floor and side walls become the outer surface of the floor and side walls and so that the surfaces of each flap previously facing toward the inside of the device face outwardly therefrom when reversed and so that a pair of carrying handles is available on the outside of the pouch when the pouch is in its original or reversed orientation wherein the securing means is a hook and loop fastener, wherein four side walls define a rectangular pouch, two opposed side walls being longer than the other two opposed side walls, and wherein there are four flaps, each of trapezoidal shape and arranged so that either pair of opposed flaps may be folded and releasably secured to one another before the other pair of flaps are folded and releasably secured to one another.

17. A carrying pouch for a rectangular food container having a flexible, rectangular floor, flexible side walls attached to each edge of the floor with adjacent ends of each side wall being attached to one another, a flap secured to the upper edge of each side wall and arranged to close the pouch when folded to a position in which the flaps are parallel to the floor and at least partially overlap one another, the pouch being fully reversible, whereby surfaces of the floor, side walls and flaps originally oriented to face inwardly become oriented to face outwardly, the visual appearance of the inwardly and outwardly facing surfaces being different from one another;

wherein two pairs of carrying handles are provided for the pouch to facilitate carrying the pouch regardless of the orientation of the surfaces, one pair of carrying handles being attached to the pouch surface originally oriented inwardly and the other pair of carrying handles being attached to the pouch surface originally oriented outwardly, and wherein each flap includes a fastener on both of the surface originally oriented inwardly and the surface originally oriented outwardly, each fastener being located adjacent the free end of the flap and the fasteners each being arranged for engaging a fastener of an opposed flap, regardless of the orientation of the surfaces.

* * * * *